United States Patent [19]

Müller

[11] 4,208,121

[45] Jun. 17, 1980

[54] APPARATUS FOR DEVELOPING LATENT IMAGES OF X-RAYED OBJECTS ON DIELECTRIC RECEPTOR SHEETS

[75] Inventor: Jürgen Müller, Munich, Fed. Rep. of Germany

[73] Assignee: AGFA-Gevaert Aktiengesellschaft, Leverkusen, Fed. Rep. of Germany

[21] Appl. No.: 919,908

[22] Filed: Jun. 28, 1978

[30] Foreign Application Priority Data

Jul. 8, 1977 [DE] Fed. Rep. of Germany ..... 2730841

[51] Int. Cl.[2] ..... G03G 15/10; G03D 3/04; G03D 3/08

[52] U.S. Cl. ..... 355/10; 118/662; 354/320; 354/330

[58] Field of Search ..... 355/3 R, 3 DR, 10, 73, 355/133; 427/15; 118/DIG. 23, 648, 649, 659, 660, 662; 250/315 R, 315 A; 354/319, 320, 329, 330

[56] References Cited

U.S. PATENT DOCUMENTS

| | | | |
|---|---|---|---|
| 3,846,817 | 11/1974 | Yamada et al. | 354/319 |
| 3,920,327 | 11/1975 | Kato | 355/14 |
| 3,967,891 | 7/1976 | Rippstein | 355/3 CH |
| 4,013,356 | 3/1977 | Bestenreiner et al. | 118/DIG. 23 |

FOREIGN PATENT DOCUMENTS

| | | | |
|---|---|---|---|
| 2526173 | 1/1976 | Fed. Rep. of Germany | 355/3 DR |

*Primary Examiner*—Fred L. Braun
*Attorney, Agent, or Firm*—Peter K. Kontler

[57] ABSTRACT

Developing apparatus for latent images of X-rayed objects on dielectric receptor sheets wherein two identical sheet carriers each of which constitutes a segment of a cylinder and extends along an arc of less than 180 degrees rotate with and relative to each other about a horizontal shaft. The peripheral surfaces of the carriers have suction ports which attract receptor sheets during travel of carriers from a starting position, past several corona discharge devices, a developing unit which can be operated to contact the latent images with a liquid developer, and a fixing unit for developed images, on to a sheet evacuating station. A roller on an arm which is rotatable on the shaft serves to drape a freshly delivered sheet onto the peripheral surface of that carrier which is held in the starting position. Discrete motors are provided for the arm and for each of the carriers. The combined length of the corona discharge devices or of the developing and fixing units, as considered in the circumferential direction of the cylinder, is less than the difference between the combined length of the peripheral surfaces of the carriers and the circumferential length of the cylinder. This renders it possible to complete the treatment of the receptor sheet on one of the carriers while the other carrier dwells in the starting position. The corona discharge devices are operative when the developing and fixing units are idle, and vice versa.

19 Claims, 1 Drawing Figure

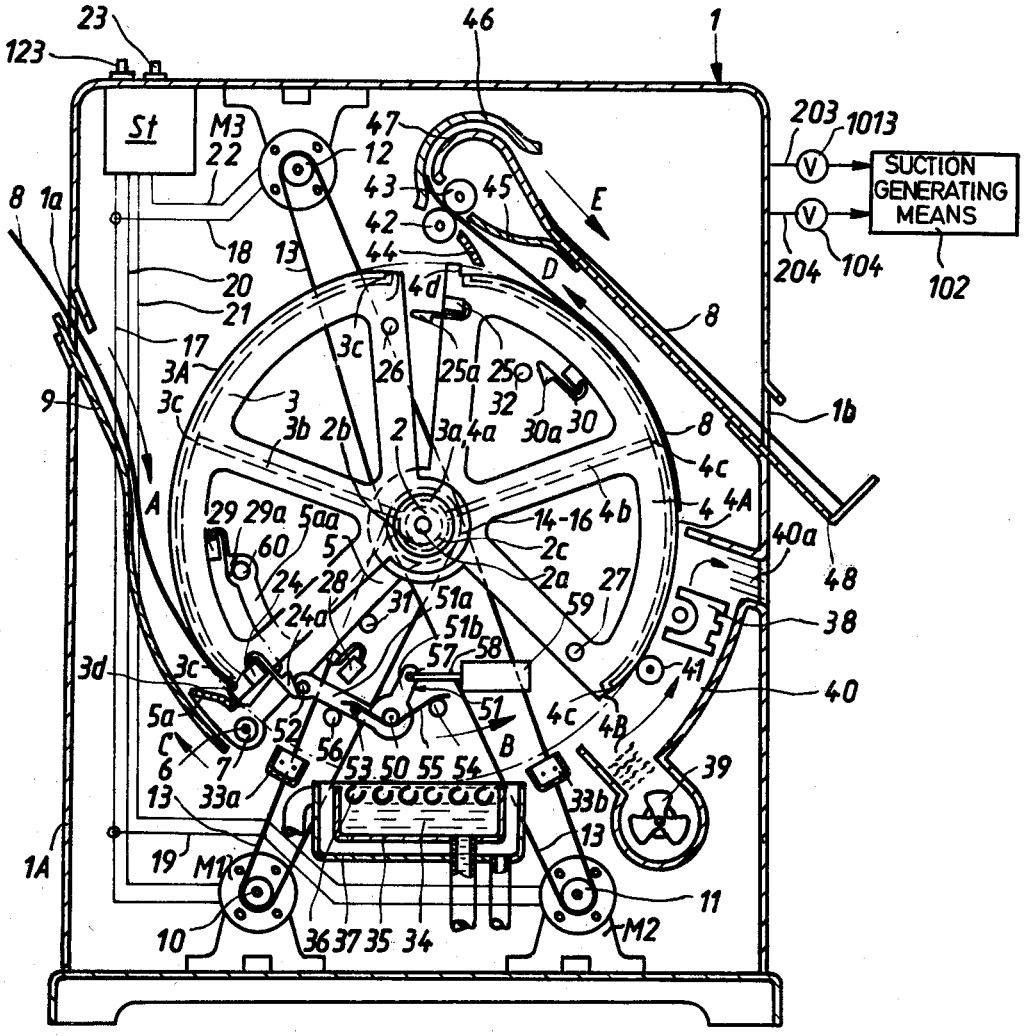
SUCTION GENERATING MEANS
St
M1
M2
M3

APPARATUS FOR DEVELOPING LATENT IMAGES OF X-RAYED OBJECTS ON DIELECTRIC RECEPTOR SHEETS

BACKGROUND OF THE INVENTION

The present invention relates to apparatus for converting latent images into visible images, especially for developing latent images of X-rayed objects on dielectric receptor sheets. Such sheets can be exposed to object-modulated X-rays in the interelectrode gap of an ionography imaging chamber, e.g., in a chamber of the type disclosed in commonly owned U.S. Pat. No. 4,021,668 granted May 3, 1977 to Friedrich Hujer et al.

An apparatus which can be utilized for development of latent images of X-rayed objects on dielectric receptor sheets is disclosed in my commonly owned copending patent application Ser. No. 863,868 filed Dec. 23, 1977. The apparatus comprises a cylindrical drum-shaped carrier whose peripheral surface can transport successive receptor sheets past a developing unit which contacts the latent images with a liquid developer. A drawback of such apparatus is that the development of the latent image on a preceding receptor sheet must be completed prior to attachment of the next sheet to the peripheral surface of the drum-shaped carrier, or the development of a latent image must be interrupted during attachment of the next-following sheet. In the first instance, the output of the apparatus is rather low. On the other hand, an interruption of development affects the quality of the developed (visible) images.

OBJECTS AND SUMMARY OF THE INVENTION

An object of the invention is to provide a novel and improved developing apparatus for latent images which is constructed and assembled in such a way that the development of the image on a preceding receptor sheet need not be interrupted during introduction and positioning of the next-following sheet.

Another object of the invention is to provide a semi-automatic developing apparatus for latent images of X-rayed objects whose output substantially exceeds the output of the aforedescribed presently known apparatus.

A further object of the invention is to provide an apparatus for uninterrupted development of latent images on successive receptor sheets or for other uninterrupted treatment of receptor sheets.

An additional object of the invention is to provide the apparatus with novel and improved plural carrier means for receptor sheets and with novel and improved means for properly attaching receptor sheets to such carrier means.

A further object of the invention is to provide the apparatus with novel and improved means for controlling the movements of carrier means and with novel and improved means for monitoring the absolute and relative positions of the carrier means.

Another object of the invention is to provide an apparatus which is relatively simple and compact and which can accept and process short, long, wide or narrow receptor sheets.

The invention is embodied in an apparatus for processing receptor sheets for latent images, especially for developing latent images of X-rayed objects on dielectric receptor sheets which were exposed to object-modulated X-rays in an ionography imaging chamber or the like. The apparatus comprises a novel and improved sheet transporting unit including a plurality of discrete carriers (e.g., two identical carriers) each of which constitutes a segment or sector of a cylinder having a predetermined radius. The carriers have convex peripheral surfaces and means (e.g., suction ports in the peripheral surfaces) for holding receptor sheets against the respective peripheral surfaces. Each carrier is movable relative to the other carrier or carriers, and the combined length of the peripheral surfaces of all carriers, as considered in the circumferential direction of the carriers, is less than the circumferential length of the aforementioned cylinder. In other words, and assuming that the transporting unit consists of two identical carriers, the length of the peripheral surface of each carrier is less than 180 degrees. The length of each peripheral surface at least equals the maximum length of receptor sheets which are treated in the apparatus.

The carriers are preferably rotatable about a common horizontal axis, together with an arm for a roller which can be caused to drape a freshly delivered receptor sheet onto the peripheral surface of that carrier which is arrested in a preselected starting position.

The apparatus further comprises means for treating receptor sheets while the sheets adhere to the peripheral surfaces of the carriers. Such treating means is outwardly adjacent to the path of movement of peripheral surfaces about the common axis of the carriers and may include one or more corona discharge devices and/or a developing unit which is operable to contact the latent images with a liquid developer containing toner particles and is located ahead of a fixing unit which stabilizes the developed (visible) images by the application of heat.

In accordance with a feature of the invention, the combined length of operative components of the treating means, as considered in the direction of rotation of the carriers, is less than or at most equals the difference between the circumferential length of the aforementioned cylinder and the combined length of the peripheral surfaces of the carriers. This renders it possible to complete the treatment of a sheet on one of the carriers while another carrier dwells in the starting position to accept a fresh receptor sheet.

The apparatus preferably comprises a discrete electric motor or another suitable prime mover for each carrier as well as for the aforementioned arm. The prime mover for the arm is reversible so that it can cause the draping roller to orbit about the common axis of the carriers in and counter to the direction of rotation of the carriers.

The novel features which are considered as characteristic of the invention are set forth in particular in the appended claims. The improved apparatus itself, however, both as to it construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE is a schematic vertical sectional view of an apparatus which is constructed and assembled in accordance with a presently preferred embodiment of the invention.

DESCRIPTION OF THE PREFERRED EMBODIMENTS

The apparatus which is shown in the drawing comprises a housing 1 which is traversed by a horizontal shaft 2 for two identical carriers 3, 4 (sheet transporting unit) and an elongated arm 5. Each carrier constitutes a segment or sector of a cylinder having a radius which is identical with the radius of the carrier 3 or 4. The shaft 2 has two axially extending blind bores 2*a* (only one shown) which extend inwardly from the respective end faces and communicate with radial bores 2*b* which, in turn, communicate with circumferential grooves 2*c* machined into the peripheral surface of the shaft 2. Each axial bore 2*a* is connected with a suitable suction generating device 102 by way of a conduit (203, 204) which contains an adjustable suction regulating valve (103, 104) and is connected to a nipple (not shown) rotatably mounted on the respective end portion of the shaft 2.

One of the circumferential grooves 2*c* is surrounded by the cylindrical hub 3*a* of the carrier 3, and the other circumferential groove 2*c* is surrounded by the cylindrical hub 4*a* of the carrier 4. The carrier 3 has a cylindrical (convex) peripheral surface 3A provided with suction ports 3*c* which are connected to the corresponding groove 2*c* (within the hub 3*a*) by one or more channels 3*b* machined into the body of the carrier 3. Analogously, the carrier 4 has a convex peripheral surface 4A provided with suction ports 4*c* in communication with the other groove 2*c* of the shaft 2 by way of channels 4*b* machined into the body of the carrier 4.

The outer end portion of the arm 5 (namely, that end portion which is remote from the shaft 2) carries a horizontal pin 6 for a roller 7. The roller 7 serves to roll or drape dielectric receptor sheets 8 onto the peripheral surfaces of the carriers 3 and 4. The outer end portion of the arm 5 further supports an arcuate guide 5*a* which consists of sheet metal or the like and slopes outwardly (away from the axis of the shaft 2) counter to the direction of delivery of successive receptor sheets 8. The guide 5*a* is located ahead of the draping roller 7 and serves to steer the leader of a sheet 8 into a pocket (3*d* or 4*d*) of the carrier 3 or 4, depending upon which of these carriers is held in a preselected starting position. In the drawing, the carrier 3 is held in such preselected starting position and the leader of a fresh sheet 8 extends into its pocket 3*d*.

The left-hand side wall 1A of the housing 1 has a downwardly inclined inlet 1*a* for admission of successive dielectric receptor sheets 8. A sheet 8 whose leader is introduced into the inlet 1*a* advances along an arcuate shroud 9 toward the aforementioned guide 5*a* which, in turn, directs the leader into the pocket 3*d* of the carrier 3. It goes without saying that the arm 5, too, must be held in the illustrated predetermined starting position in order to insure that the leader of an incoming sheet 8 will be directed into the pocket 3*d* or 4*d*. The pocket 3*d* or 4*d* need not be deep; in fact, it suffices to provide the peripheral surfaces 3A and 4A of the carriers 3 and 4 with radially outwardly extending projections in the form of shoulders or stops, as long as such projections can terminate the forward progress of the leader of an incoming sheet 8 at the exact moment when the remaining portion of the sheet is ready to be draped over the peripheral surface 3A or 4A of the carrier 3 or 4. The term "pocket" is intended to denote any suitable stop means provided at the periphery of the carrier 3 or 4 and serving to arrest the leader of an incoming sheet 8 when the respective carrier is held in the preselected starting position corresponding to that of the carrier 3.

The apparatus further comprises discrete prime movers M1, M2 and M3 (e.g., suitable electric motors) for the carriers 3, 4 and the arm 5. These prime movers serve to rotate the corresponding components about the horizontal axis of the shaft 2. The means for selecting the sequence and timing of the starting and stoppage of the prime movers M1–M3 includes a control unit St. The output elements of the prime movers M1–M3 respectively drive pulleys 10, 11 and 12. These pulleys respectively drive pulleys 14, 15, 16 which are coaxial with the shaft 2 and are respectively connected with the hubs 3*a*, 4*a* and arm 5. The means for transmitting torque from the pulleys 10–12 to the pulleys 14–16 comprises three discrete endless flexible elements 13 in the form of cords, belts or the like. The prime mover M1 is connected with the control unit St by conductor means 17, 20; the prime mover M2 is connected with the control unit by conductor means 19, 21; and the prime mover M3 is connected with the control unit by conductor means 18, 22. The control unit St comprises an actuator 23 (e.g., a pushbutton) which is depressed by the attendant to start a cycle. The direction in which the prime movers M1, M2 rotate the carriers 3, 4 with and relative to each other is indicated by the arrow B. The front end faces of the carriers (as considered in the direction of arrow B) respectively support pressure responsive switches 24 and 25 forming part of the control unit St. The switch 24 can be actuated by a trip 27 at the rear end of the carrier 4; such trip actuates the switch 24 by way of an arcuate motion receiving portion 24*a* when the front end of the carrier 3 moves sufficiently close to the rear end of the carrier 4. Analogously, the switch 25 has a motion receiving portion 25*a* which is engaged and displaced or deformed by a trip 26 at the rear end of the carrier 3 when the front end of the carrier 4 approaches the carrier 3. Thus, the switches 24, 25 can cooperate with the trips 27, 26 to indicate the positions of the carriers 3, 4 with respect to each other.

A further pressure responsive switch 28 is actuated by the arm 5 when the latter assumes the illustrated predetermined starting position in which it abuts against an arresting device in the form of a post 31 mounted in the housing 1. Actuation of the switches 24, 25 and 28 by trips 27, 26 and arm 5 respectively entails stoppage of the corresponding prime movers M1, M2 and M3.

Still further, the apparatus comprises two pressure responsive switches 29 and 30 which are respectively mounted on carriers 3 and 4 and comprise movable contacts 29*a*, 30*a*. These switches are actuated when the corresponding carriers 3 and 4 assume those positions in which the suction generating devices 102 must be disconnected from the respective suction ports 3*c* and 4*c*. The actuating means for the switches 29, 30 comprises a trip 32 which is mounted in the housing 1; this trip is installed in such position that it disconnects the ports 3*c* or 4*c* from the suction generating device 102 (i.e., by deenergizing the solenoid of the valve 103 or 104 in the conduit 203 or 204 between the suction generating device 102 and the respective bore 2*a* of the shaft 2) when a developed or otherwise treated receptor sheet 8 is ready to be detached from the peripheral surface (3A or 3B) of the respective carrier. In the drawing, the movable contact 30*a* of the pressure responsive switch 30 is about to strike against the trip 32. The conductors between the switches 24, 25, 28, 29, 30 and the main part of the control unit St have been omitted for the sake of clarity. The construction of the switches 29 and 30 (which constitute commercially available devices) is such that each of these switches opens a circuit when its movable contact engages a trip (32) for the first, third, etc. time, and that each of these switches completes the corresponding circuit when its movable contact engages a trip (60) for the second, fourth, etc. time. In other words, and referring to the switch 30 at the inner side of the carrier 4, this switch will cause the valve 104 to disconnect the ports 4*c* from the suction generating device 102 when its contact 30*a* engages the trip 32 in response to further counterclockwise rotation of the carrier 4, but the switch 30 will cause the valve 104 to connect the ports 4*c* with the device 102 when the carrier 4 thereupon completes a portion of a revolution and movable contact 30*a* is displaced or deformed by the trip 60.

The housing 1 further contains a horizontal shaft 50 (shown at the six o'clock position) for a two-armed lever 51. The arm 51*a* of the lever 51 carriers a further actuating element or trip 52 for the portions 24*a*, 25*a* of the aforementioned switches 24, 25 on the carriers 3 and 4. The trip 52 extends into the path of movement of the switch portions 24*a*, 25*a* when the lever 51 abuts against a stationary stop 56 which is mounted in the housing 1. The means for biasing the lever 51 into engagement with the stop 56 comprises a torsion spring 55 one leg of which bears against a stationary post 54, the central portion of which is convoluted around the shaft 50, and the other leg of which bears against a post 53 on the arm 51*a*. Thus, the lever 51 can be moved to a position (of abutment with the stop 56) in which its trip 52 can disconnect the prime mover M1 or M2 from the source of electrical energy (it being assumed that the prime movers are electric motors). Such stoppage of the prime movers M1 and M2 takes place when the corresponding carriers reach their preselected starting positions (corresponding to the illustrated position of the carrier 3). It will be noted that the trip 52 engages the movable contact 24*a* of the switch 24. The switches 24, 25 can cooperate with the trip 52 to transmit signals denoting the absolute positions of the carriers 3 and 4.

The other arm 51*b* of the lever 51 carries a pin 57 which is coupled to the reciprocable armature 58 of an electromagnet 59 mounted in the housing 1. When the electromagnet 59 is energized by the control unit St, the armature 58 pivots the lever 51 in a clockwise direction, as viewed in the drawing, and moves the trip 52 away from the path for the portions 24*a*, 25*a* of the switches 24, 25.

A further actuating element or trip 60 for the movable contacts 29*a*, 30*a* of the switches 29, 30 is provided on an extension 5*aa* of the arm 5.

The means for treating successive dielectric receptor sheets 8 (each sheet may carry a latent image of an X-rayed object, e.g., an image which was formed while the respective sheet was confined in the interelectrode gap of an ionography imaging chamber) comprises two corona discharge devices 33*a* and 33*b* which are outwardly adjacent to the sheets overlying the peripheral surfaces of the carriers 3 and 4, and a developing unit 34 which converts latent images into visible images by means of a liquid developer. The developing unit 34 may be similar to or identical with that which is disclosed in German Offenlegungsschrift No. 2,413,836 to which reference may be had, if necessary. As shown in the drawing, the developing unit 34 comprises an outer vessel or tank 37, an inner vessel 35, liquid discharging nozzles 36 which are mounted in the vessel 35 and discharge streams of liquid developer which forms a laminar flow contacting the outer side of a receptor sheet 8 at the periphery of the carrier 3 or 4, and conduits which connect the nozzles 36 with a pump (not shown). The pump draws liquid from the tank 37 and pumps the liquid into the nozzles 36. The liquid which issues from the nozzles 36 is accumulated in the inner vessel 35 and the tank 37 receives liquid which overflows from the inner vessel 35.

Each sheet 8 whose latent image was converted into a visible image during transport past the developing unit 34 thereupon advances past a drying and fixing unit which includes a blower 39 which is mounted in a casing 40 together with a heating device 38. The blower 39 draws hot air from a pipe 40*a* which communicates with the casing 40, and directs such air against successive increments of a sheet 8 which advances toward the heating device 38. The just described unit fixes the toner image which is obtained on development of the latent image. The heating device 38 includes means for radiating heat against successive increments of the sheet 8 which advances along the casing 40 toward an evacuating station.

The casing 40 further contains a pressure roll 41 which bears against the exposed surfaces of successive sheets 8 to insure that such sheets continue to remain adjacent to the peripheral surface 3A or 4A of the carrier 3 or 4 after the switch 29 or 30 causes the valve 103 or 104 to disconnect the respective suction ports 3*c* or 4*c* from the suction generating device 102. The roll 41 further cooperates with the adjacent carrier 3 or 4 to insure that the sheet 8 continues to advance toward the evacuating station from the corresponding suction ports 3*c* or 4*c* are already sealed from the suction generating device 102. Still further, the pressure roll 41 prevents the sheets 8 from flexing toward and into direct contact with the heating device 38. Also, the roll 41 promotes orderly removal of sheets 8 from the peripheral surfaces 3A and 4A of the carriers 3 and 4.

The means for evacuating treated sheets 8 from the housing 1 comprises two driven advancing rolls 42 and 43 which are mounted in the housing at or close to the twelve o'clock position and cause the sheets to advance into an arcuate channel between inner and outer guide members or baffles 47, 46. The channel reverses the direction of movement of successive sheets 8 and causes them to descend into a tray 48. A portion of the tray 48 extends outwardly through a downwardly inclined outlet 1*b* in the right-hand side wall of the housing to allow for convenient removal of sheets 8, either individually or in the form of stacks of two or more overlapping sheets. A stripping device 44 in the form of a suitably inclined plate of sheet metal or the like cooperates with a member 45 to form a funnel which directs the leaders of successive sheets 8 into the nip of the advancing rolls 42 and 43. The stripping device 44 is not absolutely necessary because the leaders of sheets 8 normally exhibit a tendency to move away from the peripheral surfaces of the carriers 3 and 4 as soon as the corresponding suction ports 3*c* or 4*c* are sealed from the suction generating device 102. The direction in which the sheets advance toward the nip of the rolls 42, 43 is indicated by the arrow D. The arrow E indicates the direction in which the sheets 8 descend toward the outlet 1*b*.

The operation is as follows:

On closing of a master switch 123, the control unit St starts the prime movers M1 and M2 to rotate the carriers 3 and 4 in a counterclockwise direction until one of the switches 24, 25 engages the trip 52 on the arm 51*a* of the lever 51. This arrests the prime mover M1 or M2 (it is assumed that the trip 52 was engaged by the protion 24*a* of the switch 24 on the carrier 3). The other carrier (i.e., the carrier 4) continues to rotate in a counterclockwise direction whereby the portion 25*a* of its switch 25 engages the trip 26 at the rear end of the arrested carrier 3. This results in stoppage of the prime mover M2.

A fresh sheet 8 is then introduced through the inlet 1*a* (arrow A) to slide along the shroud 9 and thereupon along the guide 5*a* so that its leader enters the pocket 3*d* of the arrested carrier 3. The arm 5 abuts against the stop 31, i.e., it is held in the predetermined starting position in which it engages the movable contact of the switch 28 to thereby open the circuit of the prime mover M3. The attendant then depresses the pushbutton 23 whereby the control unit St completes the circuit of the prime mover M3 which begins to rotate the arm 5 in a clockwise direction (as indicated by the arrow C). The trip 60 on the arm 5 actuates the switch 29 so as to connect the suction ports 3*c* with the suction generating device 102 via valve 103 in the conduit 203 while the roller 7 drapes the sheet 8 (whose leader extends into the pocket 3*d*) onto the peripheral surface 3A of the carrier 3. The sheet is attracted by the suction ports 3*c*.

When the roller 7 on the arm 5 completes the draping of the sheet 8 onto the peripheral surface 3A of the carrier 3 (this is detected by a suitable detector, such as an RC-circuit, of the control unit St), the control unit energizes the electromagnet 59 which pivots the lever 51 so that the trip 52 is disengaged from the switch 24. Thus, the prime mover M1 is started and the carrier 3 begins to rotate in a counterclockwise direction (arrow B) to advance the sheet past the corona discharge device 33*a*, developing unit 34, corona discharge device 33*b* and heating device 38 toward the stripping member 44 and into the nip of the advancing rolls 42, 43. At the same time, the control unit St starts the prime mover M3 in reverse so that the arm 5 begins to rotate in a counterclockwise direction and advances back toward the illustrated starting position. The carrier 4 begins to rotate shortly after the carrier 3 is set in motion because the trip 26 at the rear end of the carrier 3 moves away from the portion 25*a* of the switch 25. The carrier 4 is arrested when its switch 25 engages the trip 52 on the arm 51*a* of the lever 51 which, in the meantime, reassumes its illustrated position as a result of deenergization of the electromagnet 59. The carrier 4 is then arrested in the starting position and its peripheral surface 4A is ready to receive an incoming sheet 8 with a latent image thereon.

The sheet 8 which is attracted to the peripheral surface 3A of the carrier 3 is transported past the treating means including the corona discharge device 33*a*, the developing unit 34, the corona discharge device 33*b* and the heater 38 on toward the funnel which is defined by the members 44 and 45. The arrangement is such that the sheet is treated by the corona discharge devices 33*a*, 33*b* or by the developing unit 34 and the heating device 38. In the latter instance, the liquid which flows in a laminar pattern adjacent to the path of movement of the sheet 8 toward the evacuating station contacts the latent image of the sheet but does not contact the leader and the trailing portion of such sheet. This is due to the fact that the front and rear end portions 3B of the peripheral surface 3A and the front and rear end portions 4B of the peripheral surface 4A are curved inwardly, i.e., their curvature is more pronounced than the curvature of the major (central) portions of the respective peripheral surfaces. This reduces the likelihood of penetration of liquid developer between the peripheral surface 3A or 4A and the receptor sheet 8 which is adjacent to such surface. When the aforementioned pump for admission of liquid developer to the nozzles 36 is arrested (i.e., when the developing unit 34 is inoperative), the level of liquid developer in the inner vessel 35 is located below the path for the sheets 8 which adhere to the peripheral surfaces 3A and 4A. This insures that one of the corona discharge device 33*a*, 33*b* can neutralize the charge of the adjacent receptor sheet 8 and that the other corona discharge device can attract particles of dust or other foreign matter which might adhere to the exposed surface of the sheets 8. Thus, the apparatus of the present invention can be used for development of latent images or for other treatment (neutralization of charges and removal of dust particles) of receptor sheets.

When the leader of the sheet 8 on the carrier 3 advances beyond the station for the treating means 33, 33*a*, 34, 38, the movable contact 29*a* of the switch 29 engages the trip 32 so that the switch 29 opens the circuit of the solenoid of the valve 103 in the conduit 203 whereby the valve 103 seals the suction ports 3*c* from the suction generating device 102. Thus, the sheet 8 is not attracted to the peripheral surface 3A. The aforementioned pressing roller 41 causes the sheet 8 to advance with the carrier 3 (arrow D) in spite of closing of the valve 103 so that the leader of the sheet 8 enters the funnel 44, 45 and thereupon the nip of the advancing rolls 42, 43 to be transferred into the tray 48 (arrow E).

It will be noted that the illustrated carriers 3 and 4 are identical, i.e., they have identical radii and peripheral surfaces of identical length and configuration. The length of each of the peripheral surfaces 3A, 3B is less than 180 degrees, as considered in the circumferential direction of the (imaginary) cylinder of which the carriers 3 and 4 constitute two sectors or segments. The difference between the combined length of the peripheral surfaces 3A, 4A and the circumferential length of the aforementioned cylinder (whose radius equals the radius of the carrier 3 or 4) preferably exceeds (or is not less than) the combined length of the active portion of the treating means, namely, the distance from the corona discharge device 33*a* to the corona discharge device 33*b* or the distance from the left hand side of the developing unit 34 to the upper side of the heating device 38, as measured in the direction of travel of sheets 8 with the peripheral surfaces 3A and 4A. This insures that the treatment (by 33*a*, 33*b* or 34, 38) of a sheet 8 at the peripheral surface 4A of the carrier 4 can be completed while the carrier 3 dwells in the (illustrated) preselected starting position to accept a fresh sheet 8. The length of each of the peripheral surfaces 3A, 4A at least equals the length of the longest receptor sheet which is to be treated in the improved apparatus.

The just discussed selection of the length of the active portion of the treating means renders it possible to continuously treat (develop and fix, or neutralize the charges on and remove dust particles from) successive receptor sheets practically without interruptions because the carrier 4 transports a sheet past the treating station while the carrier 3 accepts a fresh sheet 8, the carrier 3 thereupon transports the fresh sheet past the treating station while the carrier 4 accepts a fresh sheet, and so forth. Actual treatment of sheets 8 (either by 33*a*, 33*b* or by 34, 38) can be carried out continuously even if the interval which is required for attachment of a fresh sheet to the peripheral surface 3A or 4A is longer than the interval which is needed to transport a sheet past the activated treating means or when the sheets 8 are not delivered at regular or frequent intervals so that a certain period of time elapses between the delivery of two successive sheets and such period is much longer than the interval which is needed for transport of a sheet past the treating station.

The trip 52 enables the switches 24, 25 to signal to the control unit St the absolute positions of the carriers 3 and 4. On the other hand, the trips 26 and 27 enable the switches 24, 25 to transmit to the control unit St signals which denote the positions of the carriers 3 and 4 with respect to each other. The switch 28 transmits to the control unit St signals indicating that the draping roller 7 is located in the predetermined starting position.

The apparatus can comprise more than two carriers. If the number of carriers is three and the carriers are of identical size and shape, their radii should be large enough to insure that each peripheral surface can carry a sheet of maximum or minimum length, and the difference between the combined length of the peripheral surfaces of all three carriers and the circumferential length of a cylinder having the same radius as the carriers preferably exceeds the length of the active elements of the treating means, as considered in the direction (arrow B) in which the carriers rotate to transport receptor sheets past the operative elements of the treating means. Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed is:

1. In an apparatus for processing receptor sheets for latent images, especially for developing latent images of X-rayed objects on dielectric receptor sheets, the combination of a sheet transporting unit including a plurality of carriers each of which constitutes a segment of a cylinder having a predetermined radius and is mounted for individual movement in a common path for all of said carriers, said carriers having convex peripheral surfaces and means for holding receptor sheets against said peripheral surfaces, said carriers being movable, the individual lengths of said peripheral surfaces, as considered in the circumferential direction of said carriers, being sufficient for said holding means to hold a different receptor sheet on each of said peripheral surfaces, and the combined length of said peripheral surfaces being less than the circumferential length of said cylinder; means for moving each of said carriers in said common path at a different speed at least during one phase of operation of the apparatus; and means for treating the receptor sheets on the peripheral surfaces of said carriers.

2. The combination of claim 1, further comprising a shaft, said carriers being rotatable about the axis of said shaft with and relative to each other.

3. The combination of claim 2, wherein said treating means is adjacent to the path of movement of said peripheral surfaces about said axis and the overall length of said treating means, as considered in the circumferential direction of said cylinder, at most equals the difference between the circumferential length of said cylinder and the combined length of said peripheral surfaces.

4. The combination of claim 3, wherein said treating means comprises a developing unit which is operable to contact the sheets on said peripheral surfaces with a liquid developer.

5. The combination of claim 4, wherein said treating means further comprises means for fixing the developed images.

6. The combination of claim 3, wherein said treating means comprises at least one corona discharge device.

7. The combination of claim 1, wherein said holding means includes suction ports provided in the peripheral surfaces of said carriers.

8. The combination of claim 7, further comprising means for draping receptor sheets onto said peripheral surfaces.

9. In an apparatus for processing receptor sheets for latent images, especially for developing latent images of X-rayed objects on dielectric receptor sheets, the combination of a sheet transporting unit including a plurality of carriers each of which constitutes a segment of a cylinder having a predetermined radius, said carriers having convex peripheral surfaces and means for holding receptor sheets against said peripheral surfaces, said carriers being movable relative to each other and the combined length of said peripheral surfaces, as considered in the circumferential direction of said carriers, being less than the circumferential length of said cylinder; discrete prime mover means for each of said carriers; and means for treating the receptor sheets on the peripheral surfaces of said carriers.

10. In an apparatus for processing receptor sheets for latent images, especially for developing latent images of X-rayed objects on dielectric receptor sheets, the combination of a sheet transporting unit including a plurality of carriers each of which constitutes a segment of a cylinder having a predetermined radius, said carriers having convex peripheral surfaces and means for holding receptor sheets against said peripheral surfaces including suction ports provided in the peripheral surfaces of said carriers, said carriers being movable relative to each other and the combined length of said peripheral surfaces, as considered in the circumferential direction of said carriers, being less than the circumferential length of said cylinder; suction generating means; means for connecting said suction ports of said carriers to said suction generating means; means for draping receptor sheets onto said peripheral surfaces; means for operating said draping means to drape a sheet onto a carrier while the respective suction ports are connected to said suction generating means; and means for treating the receptor sheets on the peripheral surfaces of said carriers.

11. The combination of claim 10, further comprising a shaft for said carriers and said draping means, and means for rotating said carriers and said draping means about the axis of said shaft, said rotating means comprising discrete prime movers for each of said carriers and for said draping means.

12. The combination of claim 11, wherein said draping means comprises a roller adjacent to the path of said peripheral surfaces about the axis of said shaft and an arm supporting said roller and rotatably mounted on said shaft.

13. The combination of claim 11, wherein said prime mover for said draping means includes a reversible motor operable to move said draping means about said axis clockwise as well as counterclockwise.

14. The combination of claim 13, further comprising control means for operating said prime movers.

15. The combination of claim 14, wherein said control means includes means for monitoring the absolute positions of said carriers.

16. The combination of claim 15, wherein said control means further comprises means for monitoring the relative positions of said carriers with respect to each other.

17. The combination of claim 14, wherein said prime movers for said carriers include motors operable by said control means to rotate said carriers in a single direction simultaneously with as well as independently of each other.

18. The combination of claim 17, wherein said control means includes means for normally maintaining said draping means in a predetermined starting position and means for arresting said carriers, one after the other, in a preselected position in which the peripheral surface of the arrested carrier is ready to receive the leader of a sheet, said control means further comprising means for thereupon starting the prime mover for said arm to cause said draping means to drape the fresh sheet onto the peripheral surface of the carrier which is arrested in said preselected position.

19. The combination of claim 18, further comprising means for automatically arresting the prime mover for one of said carriers when the other carrier rotates relative to and moves close to said one carrier and vice versa.

* * * * *